United States Patent [19]

Tanaka et al.

[11] Patent Number: 5,050,544

[45] Date of Patent: Sep. 24, 1991

[54] STRUCTURE FOR MOUNTING THE SAME TYPE OF CAMSHAFTS ON DIFFERENT TYPES OF CYLINDER HEADS

[75] Inventors: Yoshikazu Tanaka; Kazuaki Ueda, both of Toyota, Japan

[73] Assignee: Toyota Jidosha Kabushiki Kaisha, Japan

[21] Appl. No.: 526,302

[22] Filed: May 21, 1990

[30] Foreign Application Priority Data

May 22, 1989 [JP] Japan ..... 1-58077[U]

[51] Int. Cl.[5] ..... F01L 1/04

[52] U.S. Cl. ..... 123/90.27; 123/DIG. 1; 123/193 H; 384/434

[58] Field of Search ..... 123/DIG. 1, 90.27, 90.6, 123/193 H; 384/434

[56] References Cited

U.S. PATENT DOCUMENTS

| | | | |
|---|---|---|---|
| 1,556,859 | 10/1925 | L'Orange | 123/DIG. 1 |
| 2,179,709 | 11/1939 | Brecht | 123/DIG. 1 |
| 2,853,063 | 9/1958 | Leach | 123/DIG. 1 |
| 4,121,558 | 10/1978 | Sakakibara et al. | 123/DIG. 1 |
| 4,135,478 | 1/1979 | Rassey | 123/DIG. 1 |
| 4,199,202 | 4/1980 | Maeda | 384/434 |
| 4,610,224 | 9/1986 | Fujita | 123/90.31 |
| 4,729,348 | 3/1988 | Okada et al. | 123/90.27 |
| 4,915,066 | 4/1990 | Koshimoto et al. | 123/90.27 |

FOREIGN PATENT DOCUMENTS

| | | | |
|---|---|---|---|
| 0093407 | 4/1987 | Japan | 123/90.27 |
| 62-162309 | 10/1987 | Japan . | |
| 2198186 | 6/1988 | United Kingdom | 123/90.27 |

*Primary Examiner*—Willis R. Wolfe
*Assistant Examiner*—Weilun Lo
*Attorney, Agent, or Firm*—Kenyon & Kenyon

[57] ABSTRACT

A structure for mounting the same type of camshafts on two different types of cylinder heads which have reversed order of intake valve/exhaust valve arrangement, the same type of camshafts being mounted on the two types of cylinder heads so as to be staggered longitudinally by an amount delta. In the structure, thrust planes formed in the two types of cylinder heads also are staggered with respect to each other by the amount delta. Further, a single type of thrust bearing cap is provided which has a bolt hole spaced longitudinally from the transverse centerline of the bearing cap by one-half the amount delta. The bearing cap mounted to one type of cylinder head is in reversed orientation relative to the bearing cap mounted to the other type of cylinder head. This structure enables common use of the same camshaft manufacturing line and the same engine assembly line for the two types of cylinder heads.

7 Claims, 5 Drawing Sheets

( * : CONVENTIONAL)

STRUCTURE FOR MOUNTING THE SAME TYPE OF CAMSHAFTS ON DIFFERENT TYPES OF CYLINDER HEADS

BACKGROUND OF THE INVENTION

1. Field of the Invention

The present invention relates to a structure for mounting the same type of camshafts on different types of cylinder heads.

2. Description of the Prior Art

Sometimes there is a requirement to reverse access of an intake/exhaust system to an engine from a left side to a right side or from a right side to a left side with respect to a longitudinal axis of the engine without changing the basic engine design including a cylinder bore arrangement and a camshaft drive structure. Such a requirement arises, for example, when an engine for a right steering wheel vehicle is modified for installation in a left steering wheel vehicle, and both engines are assembled on the same engine assembly line.

FIG. 7 illustrates one example of the prior art methods for reversing an access of an intake/exhaust system to a cylinder head between two types of cylinder heads. In performing the reversal, the order of the camshaft drive portion X of the engine and the cylinder portion Y can not be reversed in the longitudinal direction because that would make it impossible to drive the camshaft from the same end of the engine and to mount the engine in a vehicle. Therefore, only the order of arrangement of the intake valves IN and exhaust valves EX for each cylinder is reversed, relative to the longitudinal direction of the engine, but without changing the centerline locations B of each cylinder bore and the locations of the camshaft sprockets S' in the longitudinal direction of the engine.

However, there are two problems with the above-described reversal of the access of the intake valve/exhaust valve arrangement. One problem is that the same type of camshafts can not be used with the two, different types of cylinder heads, and another problem is that the same engine assembly line can not be used for the two engine arrangements. The reasons why such common uses are impossible will be discussed below in more detail.

As illustrated in FIG. 7, in the two types of cylinder heads having intake valve/exhaust valve arrangement orders reversed with respect to each other, the location of each cam N1 of one type of engine A1' and the location of each corresponding cam N2 of the other type of engine A2' are staggered relative to each other by an amount delta (δ), while the locations of the thrust planes F1' formed at opposite ends of the thrust bearing housing and the location of the camshaft drive sprocket S' of one type of engine A1' coincide with the respective locations of the thrust planes F2' and the camshaft drive sprocket S' of the other type of engine A2' in the longitudinal direction of the engines. As a result, a distance P between the center of the thrust bearing and the center of a radial bearing located adjacent to the thrust bearing, of one type of engine A1', is smaller than a distance P' between the thrust bearing center and the adjacent radial bearing center of the other type of engine A2' by the amount delta. This means that camshafts C1 and C2 mounted on the two types of cylinder heads A1' and A2', respectively, must have different lengths between the thrust flanges and the adjacent cam journals and that camshafts manufactured on the same camshaft manufacturing line and having the same contour can not be used in common with the two types of cylinder heads.

Further, because a distance between each tapped hole, denoted with mark "x" in FIG. 7, and a reference plane used as a base plane in tapping, such as the thrust plane of the thrust bearing housing or the engine end plane, of one type of engine is different by the amount delta from a corresponding distance between each tapped hole and a corresponding reference plane of the other type of engine, the same tapping equipment setup using the same reference plane can not be used in assembly of the camshafts C1 and C2 on the two types of cylinder heads A1' and A2'. Therefore, the same engine assembly line can not be used for assembly of the two types of engines.

SUMMARY OF THE INVENTION

An object of the invention is to provide a structure for mounting the same type of camshafts on two types of cylinder heads having opposite intake valve/exhaust valve arrangement orders with respect to each other to thereby enable use of the same camshaft manufacturing line and the same engine assembly line.

In accordance with the present invention, the above-described object can be attained by a structure for mounting the same type of camshafts on two different types of cylinder heads, wherein the two types of cylinder heads have opposite intake valve/exhaust valve arrangement orders so that a transverse plane centered between an intake valve and an exhaust valve of a cylinder in one type of cylinder head is staggered longitudinally with respect to a transverse plane centered between an intake valve and an exhaust valve of a respective cylinder in the other type of cylinder head by an amount delta, cylinder bore centers of the one type of cylinder head being coincident with respective cylinder bore centers of the other type of cylinder head in locations along a line parallel to the longitudinal axis of an engine of each type.

The structure includes two types of thrust bearing housings formed in the respective types of cylinder heads, each type of thrust bearing housing having thrust planes at opposite sides thereof, the thrust planes of one type of thrust bearing housing formed in the one type of cylinder head being machined so as to be staggered from the thrust planes of the other type of thrust bearing housing formed in the other type of cylinder head by the amount delta in the longitudinal direction of each engine.

The structure also includes a single type of thrust bearing cap to be fixed to each type of thrust bearing housing, the single type of thrust bearing cap having a bolt hole longitudinally spaced from a transverse centerline of the thrust bearing cap by half the amount delta.

The structure further includes two types of tapped hole means, each including a tapped hole formed in the thrust bearing housing in the respective type of cylinder head, the tapped hole in the one type of thrust bearing housing being formed at a location spaced longitudinally by half the amount delta in one direction from a transverse plane centered between the thrust planes of the one type of thrust bearing housing formed in the one type of cylinder head, and the tapped hole in the other type of thrust bearing housing being formed at a location spaced longitudinally by half the amount delta in a direction opposite to said one direction from a transverse plane centered between the thrust planes of the other type of thrust bearing housing formed in the other type of cylinder head. The same type of camshafts are mounted in the thrust bearing housings, so that the camshaft mounted in the one type of thrust bearing housing formed in the one type of cylinder head is staggered longitudinally with respect to the camshaft mounted in the other type of thrust bearing housing formed in the other type of cylinder head by the amount delta. The single type of thrust bearing cap is mounted on each type of thrust bearing housing, with a thrust bearing cap being mounted on the one type of thrust bearing housing in reversed relation to a thrust bearing cap mounted on the other type of thrust bearing housing, and the thrust bearing cap is fixed to each thrust bearing housing by a bolt.

In the structure of the invention, the longitudinal spacings between adjacent radial bearings of the one type of cylinder head are equal to the respective longitudinal spacings between adjacent radial bearings of the other type of cylinder head, and a longitudinal spacing between one of the thrust planes and an adjacent radial bearing center for the one type of cylinder head is equal to a longitudinal spacing between a corresponding one of the thrust planes and an adjacent radial bearing center for the other type of cylinder head. Thus, camshafts manufactured on the same camshaft manufacturing line and having the same cam contours can be used for the two types of cylinder heads.

Further, a longitudinal spacing between each tapped hole of each radial bearing and a reference plane of the thrust plane for the one type of cylinder head is equal to a corresponding longitudinal spacing between each tapped hole and a reference plane of the thrust plane for the other type of cylinder head, so that the holes for the two types of cylinder heads can be tapped on the same engine assembly line using the same type of reference plane. Also, a longitudinal spacing between the tapped hole formed in the thrust bearing and the engine end plane for the one type of cylinder head is equal to the corresponding longitudinal spacing in the other type of cylinder head, so that the tapped holes formed in the thrust bearing housings for the two types of cylinder heads can be tapped on the same engine assembly line using the same engine end planes as reference planes.

In the above-described structure, the tapped hole is spaced longitudinally from the transverse center plane of the one type of thrust bearing housing by half the amount delta in one direction for the one type of cylinder head, while the corresponding tapped hole is spaced from the transverse center plane of the other type of thrust bearing housing by half the amount delta in an opposite direction for the other type of cylinder head. The same type of thrust bearing cap having a bolt hole at a position offset from the transverse centerline of the bearing cap by half the amount delta can be mounted on either of the two types of thrust bearing housings formed in the two types of cylinder heads simply by reversing the thrust bearing cap with respect to the two types of cylinder heads. Thus, the single type of thrust bearing cap can be used for both of the two types of cylinder heads.

In this way, the same type of camshafts and the same engine assembly line can be used for the two types of cylinder heads. Modifications necessary for the common use of the camshaft and the engine assembly line include only an offset drilling of a bolt hole in the thrust bearing cap, an offset machining of the thrust planes, and an offset tapping of the tapped holes for the thrust bearings. These do not need a substantial increase in the manufacturing and assembly cost, but a common use of a single type of camshaft and the same engine assembly line greatly decreases the manufacturing and assembly cost.

BRIEF DESCRIPTION OF THE DRAWINGS

The above and other objects, features, and advantages of the present invention will become apparent and will be more readily appreciated from the following detailed description of the preferred exemplary embodiment of the present invention taken in conjunction with the accompanying drawings, in which.

DETAILED DESCRIPTION OF THE PREFERRED EMBODIMENT

Figure 1:
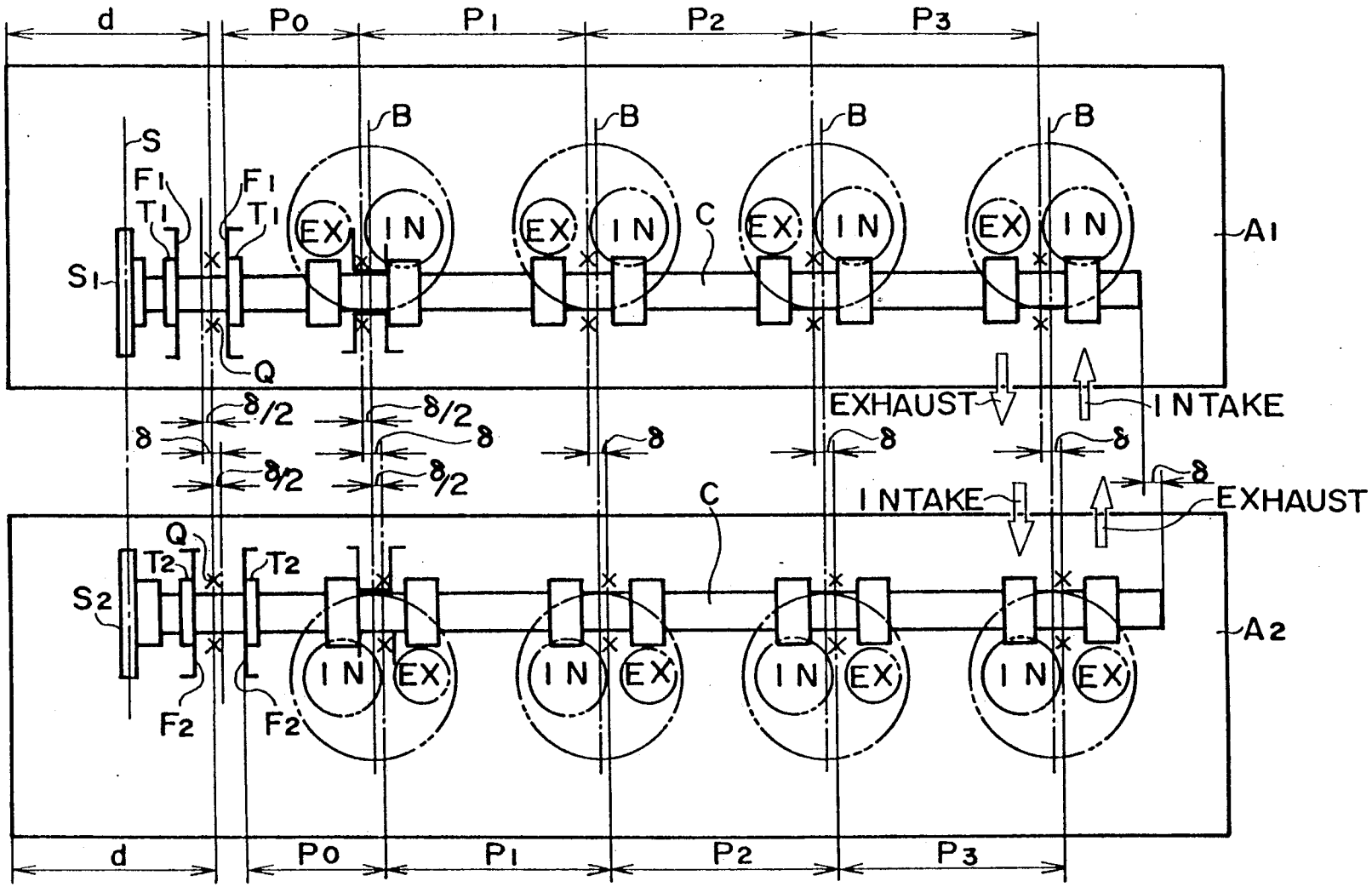
FIG. 1 is a schematic plan view of two types of cylinder heads, each fitted with a single type of camshaft in accordance with one embodiment of the present invention.

As illustrated in FIG. 1, two types of cylinder heads A1 and A2 have intake valve/exhaust valve arrangement orders reversed with respect to each other and have cylinder-bore center positions B and camshaft drive sprocket positions S coincident with each other in a direction parallel to longitudinal axes of cylinder heads. More particularly, one type of cylinder head A1 has the arrangement order of an exhaust valve EX first and an intake valve IN second in a direction away from a thrust bearing, while the other type of cylinder head A2 has the arrangement order of an intake valve IN first and an exhaust valve EX second in the same direction. Due to the reversed intake valve/exhaust valve arrangement orders, an access of an intake/exhaust system to the cylinder head A1 and an access of an intake/exhaust system to the cylinder head A2 are reversed with respect to each other in a direction perpendicular to the longitudinal axes of the engines. One type of cylinder head can be used for an engine to be mounted in a right steering wheel vehicle, while the other type of cylinder head can be used for an engine to be mounted in a left steering wheel vehicle.

Because sizes of the intake valve IN and the exhaust valve EX differ from each other (usually, the diameter of an intake valve is greater than the diameter of an exhaust valve), a transverse plane centered between the intake valve IN and the exhaust valve EX for each cylinder bore is offset from the bore center B in the longitudinal direction of the engine, and the directions of offset are opposite with respect to the two types of cylinder heads A1 and A2. The offset amount of the transverse center plane, intersecting the marks "x" between the intake valve IN and the exhaust valve EX, from the bore center B is half an amount delta (δ) for each type of cylinder head, and therefore, the transverse center plane between each pair of intake valve IN and exhaust valve EX for the cylinder head A1 and the transverse center plane between the corresponding pair of intake valve IN and exhaust valve EX for the cylinder head A2 are staggered from each other by the amount delta in the direction parallel to the longitudinal axes of the engines. By contrast, the positions of the bore centers B for the cylinder head A1 are designed to coincide with corresponding bore centers B for the cylinder head A2 in the direction parallel to the longitudinal axes of the engines, so that the same basic engine design can be used in common for the two types of engines. Also, because two types of camshaft drive sprockets S1 and S2 are positioned at the same end portions of the two types of engines, the camshafts C can be driven from the same ends of the engines when using either of the two types of cylinder heads A1 and A2. The tooth portions of the two types of cam shaft drive sprockets S1 and S2 lie in the same plane perpendicular to longitudinal axis of each of the two types of engines, so that no substantial change in design is necessary for the camshaft drive portions of the cylinder heads A1 and A2 and camshaft drive members, such as the crankshaft and timing belt, except for the bosses of the camshaft drive sprockets S1 and S2. Thus, the two types of cylinder heads A1 and A2 having the above-described basic designs can be manufactured on a single cylinder head manufacturing station M3 (see FIG. 6).

A single type of camshaft C manufactured on the same camshaft manufacturing line or station M2 (see FIG. 6) and therefore having the same cam contours is mounted on each of the two types of cylinder heads A1 and A2. Thus, the camshaft C to be mounted to the cylinder head A1 and the camshaft C to be mounted to the cylinder head A2 have the same pitches P1, P2, P3 between cam journals and the same pitch P0 between the thrust flange T1 or T2 and the adjacent cam journal with respect to the two types of cylinder heads A1 and A2.

When the single type of camshaft C having the same cam contours is mounted on each of the two types of cylinder heads A1 and A2, the camshaft C mounted on the cylinder head A1 and the camshaft C mounted on the cylinder head A2 are staggered with respect to each other by an amount delta in the direction parallel to the longitudinal axes of the engines as illustrated in FIG. 1. Therefore, the thrust flanges T1 of the camshaft C mounted on the cylinder head A1 and the thrust flanges T2 of the camshaft C mounted on the cylinder head A2 are also staggered with respect to each other by the amount delta in the direction parallel to the longitudinal axes of the engines.

Correspondingly, as illustrated in FIG. 1, thrust planes F1 at opposite sides of the thrust bearing housing formed in the cylinder head Al and thrust planes F2 at opposite sides of the thrust bearing housing formed in the cylinder head A2 are machined so as to be staggered with respect to each other by the amount delta in the direction parallel to the longitudinal axes of the engines. This machining is performed in a cylinder head manufacturing station M3 (see FIG. 6) before the cylinder head is conveyed to the engine assembly line M5 (see FIG. 6). More particularly, the thrust bearing housings are initially cast so as to have a greater width than finally needed for both types of thrust bearing housings. Then, when the sides of the thrust bearing housing are machined, the machining amount and machining direction are controlled so that the thrust planes F1 and F2 are staggered with respect to each other in the direction parallel to the longitudinal axes of the engines. Creating the staggered thrust planes Fl and F2 requires only a change in the control commands for the machining amount and machining direction. This does not involve any substantial change in the cylinder head manufacturing method at the station M3 (see FIG. 6), so there is no significant increase in manufacturing cost.

Figure 4:
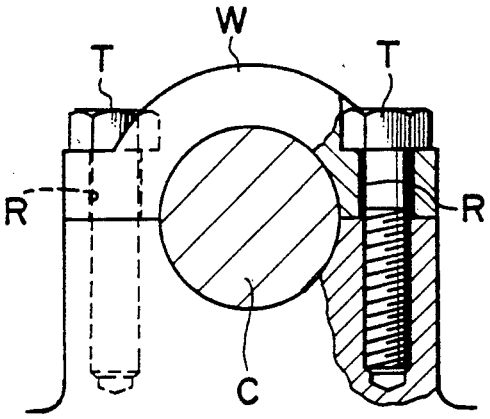
FIG. 4 is an elevational view (partially in section) taken in the longitudinal direction of the camshaft of the thrust bearing of FIGS. 2, 3A and 3B.
Figure 3A:
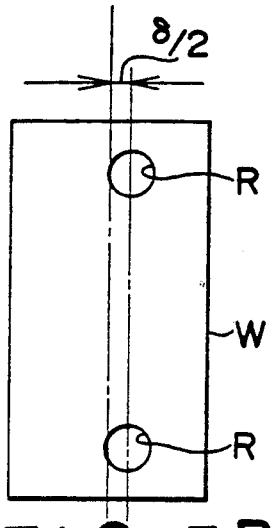
FIG. 3A is a plan view of a single type of thrust bearing cap oriented as to be mounted on one of the two types of thrust bearing housings of FIG. 2.
Figure 3B:
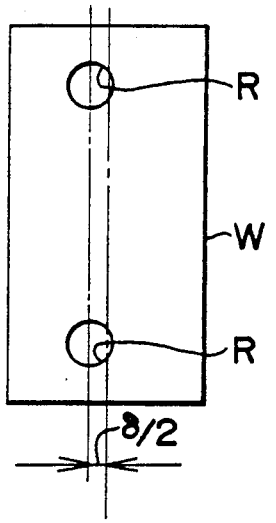
FIG. 3B is a plan view of the bearing cap of FIG. 3A oriented for mounting on the other of the two types of thrust bearing housings of FIG. 2.
Figure 6:
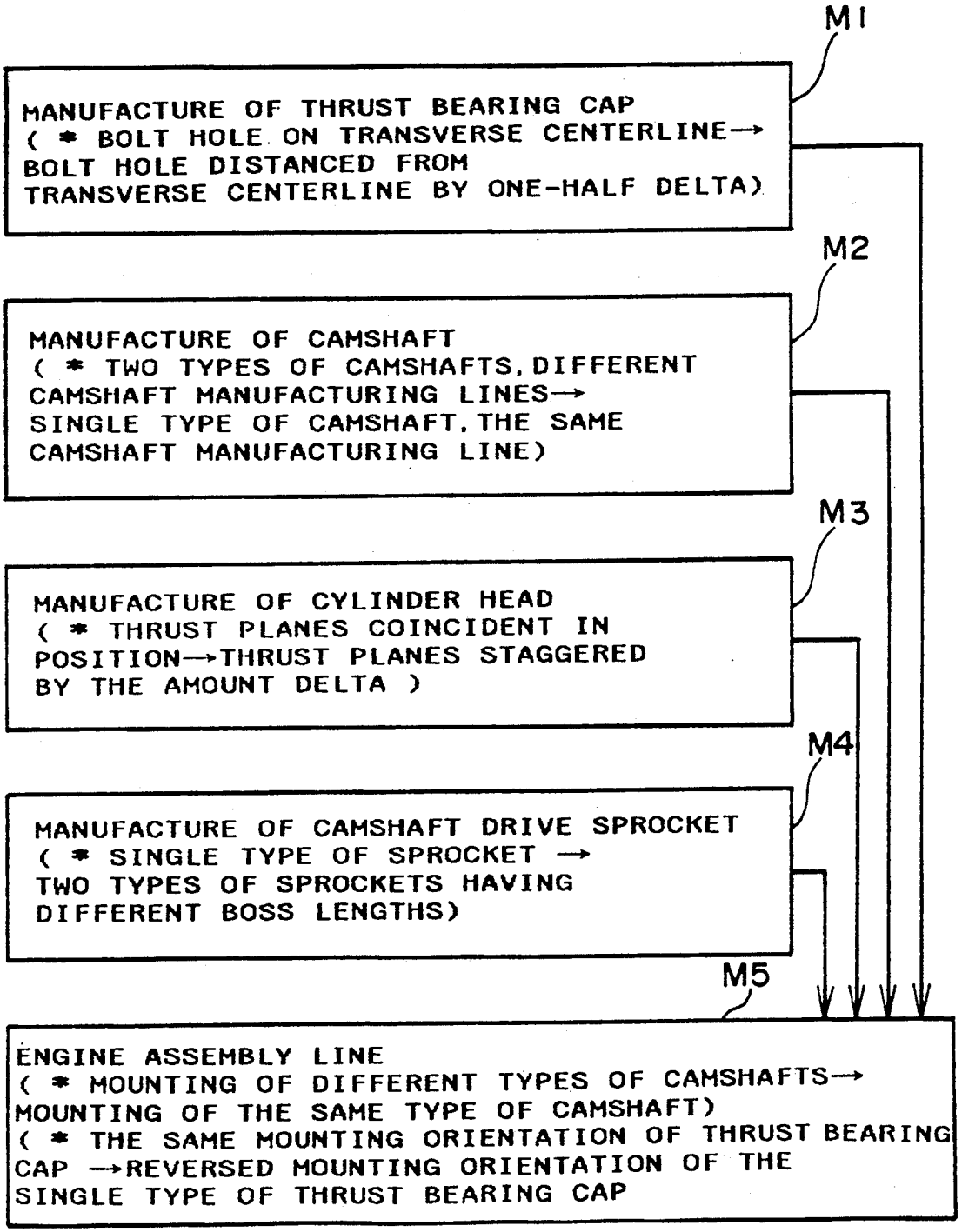
FIG. 6 is a block diagram illustrating manufacturing and assembly steps of camshafts, cylinder heads, and thrust bearing caps in accordance with the present invention in comparison with the conventional art.
Figure 7:
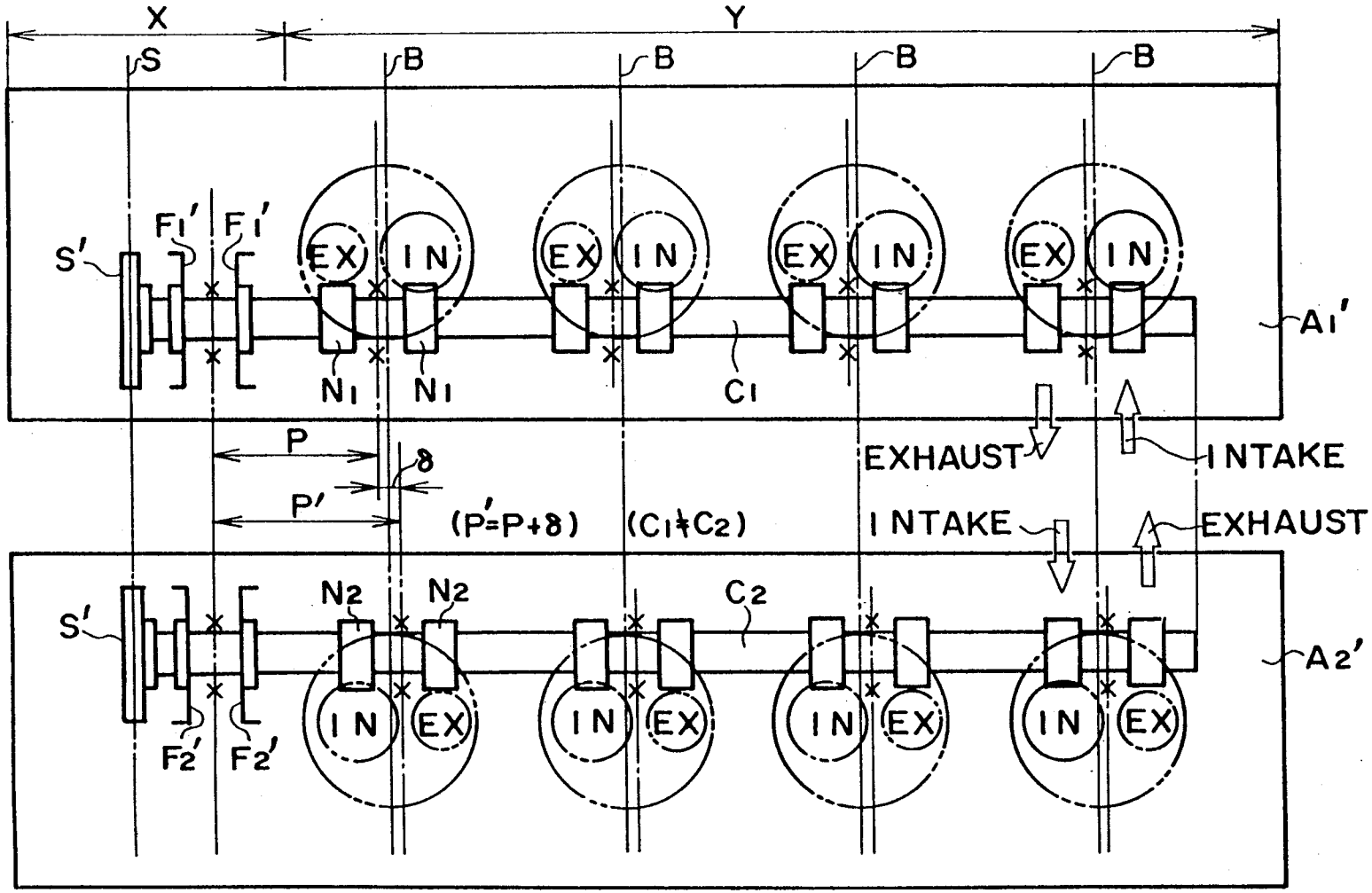
FIG. 7 (PRIOR ART)
FIG. 7 is a schematic plan view of two types of cylinder heads fitted with different types of camshafts in accordance with the prior art.

A single type of bearing cap W for the thrust bearing is manufactured in a bearing cap manufacturing station M1 of FIG. 6 which is independent of the assembly line M5. In the bearing cap manufacturing station, as illustrated in FIG. 3A, bolt holes R through each of which a bolt T (see FIG. 4) is to extend is drilled at a position offset from the transverse centerline of the bearing cap W by one-half the amount delta in the width direction of the thrust bearing cap. The single type of thrust bearing cap W is used for the two types of cylinder heads A1 and A2 by reversing the mounting direction (i.e. by rotating through 180°) when mounting the bearing caps W to the two types of cylinder heads A1 (FIG. 3A) and A2 (FIG. 3B).

Figure 5:
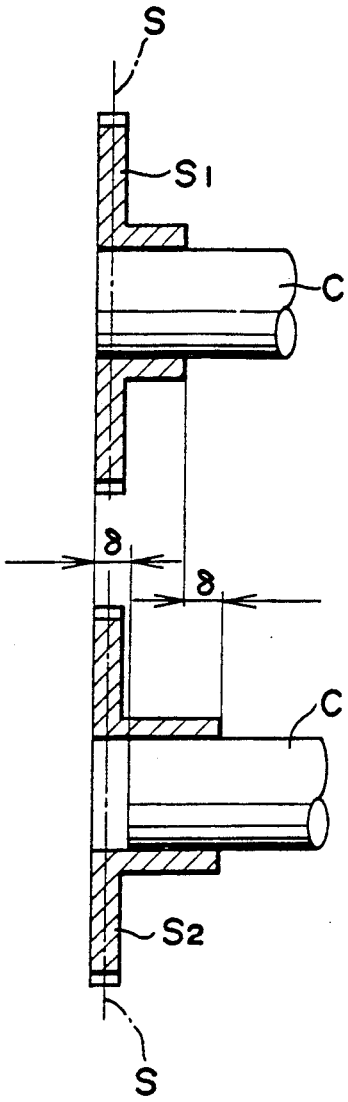
FIG. 5 is an enlarged, partial cross-sectional view of two types of camshaft drive sprockets and the vicinity thereof of FIG. 1.

Two types of camshaft drive sprockets S1 and S2 are manufactured at a sprocket manufacturing station M4 as illustrated in FIG. 6. The two types of camshaft drive sprockets S1 and S2 have the same structure except for the bosses thereof. As illustrated in FIG. 5, the boss of the camshaft drive sprocket S1 to be mounted on the cylinder head A1 is shorter than the boss of the camshaft sprocket S2 to be mounted on the cylinder head A2 by the amount delta. However, an engaging length between the camshaft drive sprocket S1 and the camshaft C is equal to an engaging length between the camshaft drive sprocket S2 and the camshaft C, because the drive sprocket S2 extends beyond the end of the camshaft by the amount delta.

The above-described common bearing cap W, common camshaft C, two types of cylinder heads A1 and A2, and two types of camshaft drive sprockets S1 and S2 are conveyed to the same engine assembly line M5 shown in FIG. 6 and are assembled in a way described below.

Figure 2:
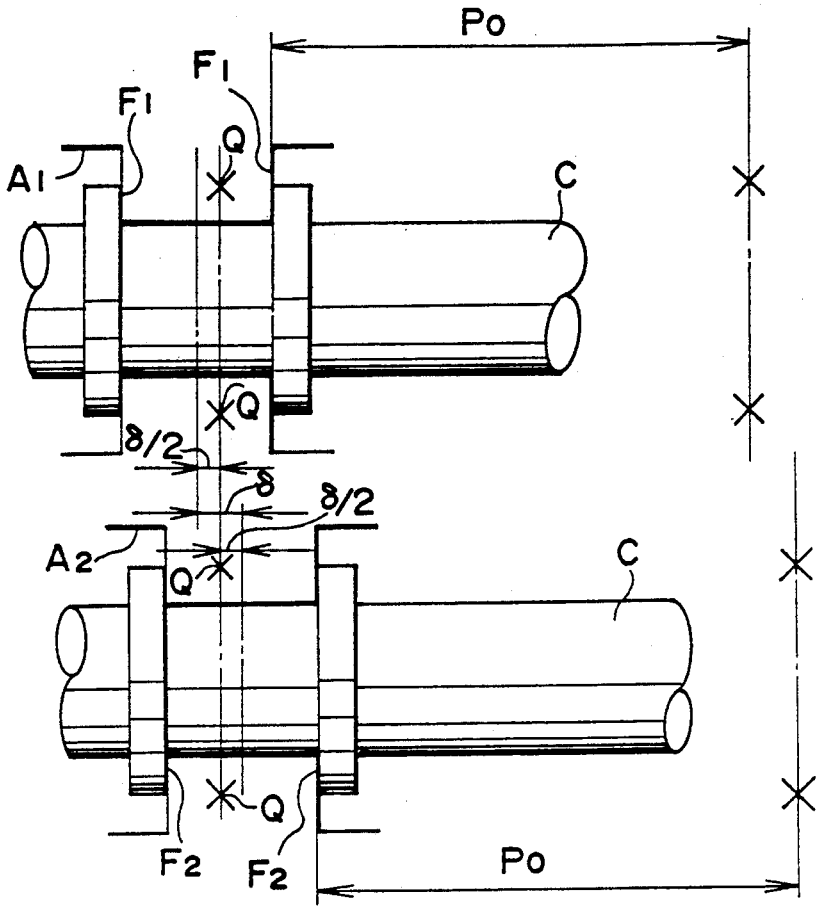
FIG. 2 is an enlarged, partial plan view illustrating two types of thrust bearing housings and the vicinity thereof of FIG. 1.

At first, tapped holes for use in fastening the thrust bearing caps W and radial bearing caps are formed in the cylinder heads A1 and A2. The tapped holes Q for use in fastening the thrust bearing cap W are formed, as illustrated in FIGS. 1 and 2, at locations spaced from the transverse plane centered between the opposite thrust planes F1 and F1 by one-half the amount delta in a direction away from the sprocket tooth position S in the case of cylinder head A1 and at locations spaced from the transverse plane centered between the opposite thrust planes F2 and F2 by one-half the amount delta in a direction toward the sprocket tooth position S in the case of cylinder head A2. As a result, the tapped holes Q formed in the cylinder head A1 and the tapped holes Q formed in the cylinder head A2 lie in the same transverse plane with respect to the two types of engines and are spaced by the same distance d from the same reference planes, for example, the longitudinal end planes of the cylinder heads A1 and A2. This use of the same reference plane for both types of engines enables assembly of camshafts using the same operating cycle of the same assembly line without stopping the operation of the line to adjust tapping pitches. Similarly, because the pitches P1, P2, and P3 between the tapped holes for the radial bearings and the pitch P0 between the thrust plane and the tapped hole for the adjacent radial bearing for the cylinder head A1 are equal to those for the cylinder head A2, the tapped holes for the radial bearings can be formed on the same assembly line with respect to the two types of engines using the same reference plane (i.e., thrust plane F1 or thrust plane F2).

Then, the single type of camshaft C is mounted in the bearing housings of the thrust bearing and the radial bearings. In this instance, the camshaft C mounted on the cylinder head A1 is staggered from the camshaft C mounted on the cylinder head A2 by the amount delta in the direction parallel to the longitudinal axes of the engines. Then, the single type of thrust bearing cap W and radial bearing caps are mounted on the bearing housings and fixed to the bearing housings by means of bolts. When the single type of thrust bearing cap W is mounted, the mounting direction of the cap W in the case of mounting to the cylinder head A1 is reversed from that in the case of mounting to the cylinder head A2. More particularly, when the cap W is mounted on the thrust bearing housing shown in the upper portion of FIG. 2, the cap W is oriented as shown in FIG. 3A. In contrast, when the cap W is mounted on the thrust bearing housing shown in the lower portion of FIG. 2, the cap W is oriented as shown in FIG. 3B. Due to the reversed setting, the bolt holes R formed in the thrust bearing cap W match the locations of the tapped holes Q formed in the thrust bearing housing, and the bolt T can penetrate the bolt holes R and be screwed into the tapped holes Q.

In accordance with the above-described structure, there are two great merits: common use of a single type of camshaft for different types cylinder heads and common use of the same type of engine assembly line for different types of engines. The two merits will be discussed in more detail below with reference to FIG. 6 which illustrates differences between the present invention and the prior art.

Firstly, the common use of a single type of camshaft will be discussed. Corresponding to the reversal of the order of intake valve/exhaust valve between the two types of cylinder heads A1 and A2, the camshaft C mounted on cylinder head A1 is staggered with respect to the camshaft C mounted on cylinder head A2 by the amount delta in the direction parallel to the longitudinal axes of the engines. Due to the staggered mounting of the camshafts, the thrust planes of the thrust bearing housings on the two types of cylinder heads A1 and A2 should be formed so as to be also staggered by the amount delta in the direction parallel to the longitudinal axes of the engines.

In this connection, the locations of the radial bearings need not be staggered, because there are sufficient gaps between the sides of radial bearings and the cams to easily absorb the amount delta, as illustrated in FIG. 1. The staggered formation of the thrust planes F1 and F2 can be easily achieved by initially casting the thrust bearing housings of the cylinder heads A1 and A2 with excess width and then machining the sides of the thrust bearing housings to form necessary thrust planes F1 and F2 by changing the control commands for the machining amount and machining direction. The cylinder head manufacture in the present invention is changed from the prior art only in the above-described staggered formation of the thrust planes F1 and F2 as illustrated in the station M3 of FIG. 6. Despite the staggered mounting of the camshafts, the tooth portions of camshaft drive sprockets S1 and S2 are made coincident in position between the two types of cylinder heads A1 and A2 due to the different lengths of the bosses of the two types of sprockets S1 and S2. The staggered formation of the thrust planes F1 and F2 and use of the two types of sprockets S1 and S2 enable mounting the single type of camshaft C on the two types of cylinder heads A1 and A2 and, as a result, common use of the same camshaft manufacturing line or station as illustrated in the station M2 of FIG. 6.

Next, common use of the same engine assembly line will be discussed. To use the same assembly line, it is necessary that the tapped holes formed in the two types of cylinder heads A1 and A2 should have the same pitches and should be spaced from the same type of reference planes by the same distance so that the same kind of tapping using the same type of reference planes can be used for the two types of cylinder heads. In the present invention, the tapped holes Q for the thrust bearing housings are located at the same distance D from the same reference planes (i.e., engine end planes) with respect to the two types of cylinder heads A1 and A2. Further, the tapped holes for the radial bearings have the same pitches and are located at the same distances from the same type of reference planes (i.e., thrust planes F1 and F2) with respect to the two types of cylinder heads A1 and A2. Therefore, common use of the same assembly line is possible for the two types of engines. In this instance, though the tapped holes Q are offset from the transverse centerline of each thrust bearing, the thrust bearing cap having bolt holes offset from the transverse centerline can absorb the offsetting of tapped holes Q. Due to the offsetting of the bolt holes, a single type of thrust bearing cap be used for the two types of thrust bearings as illustrated in the station M1 of FIG. 6. The above-described common tapping and common thrust bearing cap enable common use of the same engine assembly line for assembly of the two types of engines having reversed intake valve/exhaust valve arrangement orders without stopping the operation of the assembly line to adjust the tapping pitches, as illustrated in the assembly M5 of FIG. 6. In the assembly, parts of the two types of engines, for example, an engine for a right steering wheel vehicle and an engine for a left steering wheel vehicle can be supplied to the same operating cycle of the same assembly line to be assembled.

Although only one preferred embodiment of the invention has been described in detail, it will be appreciated by those skilled in the art that various modifications and alterations can be made to the particular embodiment shown without materially departing from the novel teachings and advantages of the present invention. Accordingly, it is to be understood that all such modifications and alterations are included within the spirit and scope of the present invention as defined by the following claims.

What is claimed is:

1. A structure for mounting the same type of camshafts on two different types of cylinder heads, wherein the two types of cylinder heads have opposite intake valve/exhaust valve arrangement orders so that a transverse plane centered between an intake valve and an exhaust valve of a cylinder in one type of cylinder head is staggered longitudinally with respect to a transverse plane centered between an intake valve and an exhaust valve of a respective cylinder in the other type of cylinder head by an amount delta, cylinder bore centers of the one type of cylinder head being coincident with respective cylinder bore centers of the other type of cylinder head in locations along a line parallel to the longitudinal axis of an engine of each type, the structure comprising:

two types of thrust bearing housings, one type of bearing housing being formed in one type of cylinder head and the other type of bearing housing being formed in the other type of cylinder head, each type of thrust bearing housing having thrust planes at opposite sides thereof, the thrust planes of the one type of thrust bearing housing formed in the one type of cylinder head being machined so as to be staggered with respect to the thrust planes of the other type of thrust bearing housing formed in the other type of cylinder head by an amount delta in the direction parallel to the engine longitudinal axes;

a single type of thrust bearing cap adapted to be fixed to each of the two types of thrust bearing housings, the single type of thrust bearing cap having a bolt hole spaced from a transverse centerline of the thrust bearing cap by one-half the amount delta; and two types of tapped hole means, each including a tapped hole formed in the thrust bearing housing in the respective type of cylinder head, the tapped hole in the one type of thrust bearing housing being provided at a location spaced longitudinally by one-half the amount delta in one direction from a transverse plane centered between the thrust planes of the one type of thrust bearing housing formed in the one type of cylinder head and the tapped hole in the other type of thrust bearing housing being provided at a location spaced longitudinally by one-half the amount delta in a direction opposite to said one direction from a transverse plane centered between the thrust planes of the other type of thrust bearing housing formed in the other type of cylinder head, the same type of camshafts being mounted in the thrust bearing housings so that the camshaft mounted in the one type of thrust bearing housing formed in the one type of cylinder head is staggered longitudinally with respect to the camshaft mounted in the other type of thrust bearing housing formed in the other type of cylinder head by the amount delta, the single type of thrust bearing cap being mounted on each type of thrust bearing housing, with a thrust bearing cap being mounted on the one type of thrust bearing housing in reversed relation to a thrust bearing cap mounted on the other type of thrust bearing housing and the thrust bearing cap being fixed to each thrust bearing housing by a bolt which penetrates the bolt hole and is screw-coupled to the respective tapped hole.

2. The structure according to claim 1, further comprising two types of camshaft drive sprockets, one type of camshaft drive sprocket being mounted on the camshaft of the one type of cylinder head and the other type of camshaft drive sprocket being mounted on the camshaft of the other type of cylinder head, each type of camshaft drive sprocket having a toothed portion and a boss, the toothed portion of the one type of camshaft drive sprocket lying in the same transverse plane as the toothed portion of the other type of camshaft drive sprocket relative to the engine longitudinal axes, the boss of the one type of camshaft drive sprocket having a different length than the boss of the other type of camshaft drive sprocket by the amount delta.

3. The structure according to claim 1, wherein the camshafts for the two types of cylinder heads are manufactured on the same camshaft manufacturing line and have the same cam contours.

4. The structure according to claim 1, wherein the tapped holes formed in the two types of cylinder heads are tapped on the same engine assembly line using the same type of reference planes.

5. The structure according to claim 1, wherein one type of the two types of cylinder heads includes a cylinder head for use in an engine for a right steering wheel vehicle and the other type of the two types of cylinder heads includes a cylinder head for use in an engine for a left steering wheel vehicle.

6. A structure for mounting the same type of camshafts on two different types of cylinder heads, wherein the two types of cylinder heads have reversed order of intake valve/exhaust valve arrangement so that a transverse plane centered between an intake valve and an exhaust valve of one type of cylinder head is staggered from a transverse plane centered between a corresponding intake valve and an exhaust valve of the other type of cylinder head by an amount delta, the structure comprising:

a single type of thrust bearing cap mounted on the two types of cylinder heads, the single type of thrust bearing cap having a bolt hole spaced from a transverse centerline of the thrust bearing cap by one-half the amount delta.

7. A structure for mounting the same type of camshafts on two different types of cylinder heads, wherein the two types of cylinder heads have reversed order of intake valve/exhaust valve arrangement so that a transverse plane centered between an intake valve and an exhaust valve of one type of cylinder head is spaced longitudinally from a transverse plane centered between a corresponding intake valve and an exhaust valve of the other type of cylinder head by an amount delta, the structure comprising:

two types of camshaft drive sprockets, one type of camshaft drive sprocket being mounted on the one type of cylinder head and the other type of camshaft drive sprocket being mounted on the other type of cylinder head, each type of camshaft drive sprocket having a toothed portion and a boss, the toothed portion of the one type of camshaft drive sprocket lying in the same transverse plane as the toothed portion of the other type of camshaft drive sprocket relative to the longitudinal axes of the engines, a boss of the one type of camshaft drive sprocket being different in length from a boss of the other type of camshaft drive sprocket by the amount delta.

* * * * *